United States Patent [19]

Gouldey

[11] Patent Number: 4,864,270

[45] Date of Patent: Sep. 5, 1989

[54] THERMOSTATIC CONTROLLER FOR WATERBED HEATER

[75] Inventor: Glenn C. Gouldey, Carol Stream, Ill.

[73] Assignee: Eaton Corporation, Cleveland, Ohio

[21] Appl. No.: 287,758

[22] Filed: Dec. 21, 1988

[51] Int. Cl.[4] ..... H01H 37/38; H01H 37/36

[52] U.S. Cl. ..... 337/321; 337/323; 337/327

[58] Field of Search ..... 337/321, 320, 322, 323, 337/327, 119, 120, 121; 219/217

[56] References Cited

U.S. PATENT DOCUMENTS 3,293,394 12/1966 Staples ..... 337/321

4,700,168 10/1987 Sirois et al. ..... 337/327

*Primary Examiner*—H. Broome

*Attorney, Agent, or Firm*—R. A. Johnston

[57] ABSTRACT

A thermostatic controller for a waterbed heater of the type where the water bladder is enclosed in a foam casing with the controller disposed between the bladder and the side of the casing. The controller has a liquid filled bulb and capillary temperature sensor disposed in a sensing chamber isolated by dead air from a separate walled switching chamber having a diaphragm type actuator connected to the capillary tube for moving a lever spring biased against the actuator and operable to actuate a snap switch. An adjustment camshaft extends externally of the controller housing for adjusting the bias on the lever for changing the temperature at which the snap switch is actuated.

10 Claims, 3 Drawing Sheets

THERMOSTATIC CONTROLLER FOR WATERBED HEATER

BACKGROUND OF THE INVENTION

The present invention relates to supplying electric current to resistance heaters for maintaining the temperature at a desired level in the bladder of a water bed.

In the design and manufacture of waterbeds, it has been found desirable to enclose the water filled bladder in a casing for added user comfort. Water bed mattresses of this type have come to be referred to as "soft side" mattresses because of the several inches of foam material provided in the casing along the sides of the mattress. In this type of mattress a foam casing provides a secondary water containment in the event of a leak in the bladder. The foam casing must therefor be sufficiently wide to provide the stiffness necessary to maintain the containment if the bladder is ruptured and water fills the casing.

In the aforesaid soft side type waterbed mattress assemblies, it has been found convenient to provide the heater element for the bladder under the bladder and dispose the controller between the side of the bladder and the foam material forming the sides of the casing. In this type of arrangement, the controller is thus disposed with its side faces in a generally vertical orientation.

In soft side waterbed mattresses where the controller for the water bladder heater is disposed with the faces thereof in a vertical arrangement, it has been found that the heat generated by arcing of the contacts during switching of the current load for the heater has affected the temperature sensing element employed in the controller, thus causing the switch actuator to cycle power to the heater at false temperature settings with respect to the temperature of the water in the bladder. This has been found particularly troublesome where the switching mechanism employed bimetal temperature sensitive components.

It has thus been desired to find a way or means of providing a thermostatic controller for a soft side waterbed mattress which can be disposed vertically between the sides of the water bladder and a foam casing and yet one which will not be affected by the heat generated from the contacts switching current for the heater.

SUMMARY OF THE INVENTION

The present invention provides a thermostatic controller for a waterbed mattress heater where the controller is to be mounted or disposed along the side of the water bladder and a foam bladder casing.

The controller has a liquid filled temperature sensing bulb and capillary, with the bulb disposed in a sensing chamber with dead air space around the sensing bulb. A snap acting switch is disposed vertically above the sensing bulb in a separate chamber isolated from the sensing bulb by the dead air space. The capillary is connected to a diaphragm type actuator which has a lever spring biased thereagainst for responding to movement of the diaphragm to actuate the snap switch. A rotatable cam shaft provides an adjustable fulcrum for the lever to enable the user to adjust the temperature point of actuation of the snap switch. The lever includes an adjustment screw for calibrating the setting of the bias of the spring against the lever adjustment screw is accessible from the exterior of the casing movement thereof after calibration. The present invention thus provides a thermostatic controller for a waterbed heater which employs a snap acting switch with dead air space isolating the switch from a bulb and capillary temperature sensor to prevent the heat from switch contact arcing from effecting the temperature sensed by the bulb.

DETAILED DESCRIPTION

Figure 1:
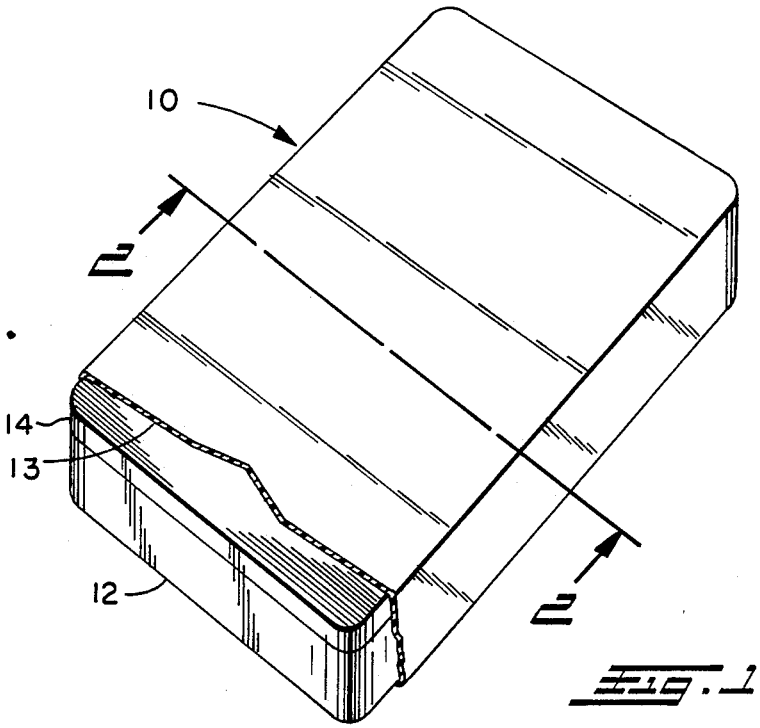
FIG. 1 is a somewhat perspective view of a soft side waterbed mattress assembly.

Referring to FIG. 1, a waterbed mattress of the soft side type is illustrated generally at 10 as having a lower portion of a casing indicated by reference numeral 12 and an upper portion 14 with an outer fabric cover 13.

Figure 2:
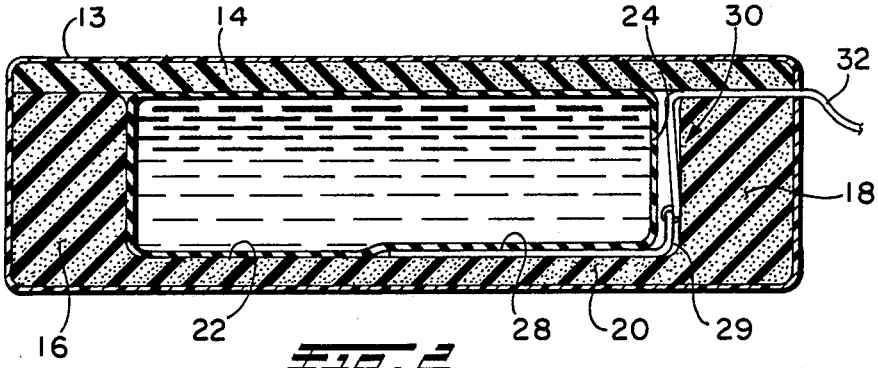
FIG. 2 is a section view taken along section-indicating lines 2—2 of FIG. 1.

Referring to FIG. 2, the lower portion of the casing 12 comprises an integrally formed pair of sidewalls 16,18 which, in cooperation with a bottom layer 20 form cavity 22 which is capable of retaining water in the event of a leak in the bladder as will hereinafter be described.

The water filled bladder 24 is received in cavity 22 and the upper or top section of the mattress foam casing 14 is extended over the bladder 22 and the sidewalls 16,18 of the lower section to completely encase the bladder 24. The outer cover 13 completely encases the foam to provide the comfort of a fabric surface for the user. A heating element indicated by reference numeral 28 is disposed between the lower surface of the bladder 24 and the bottom portion 20 of the foam casing. Heater 28 is connected to a controller, indicated generally at 30, which has a generally rectangular configuration and is disposed between the right sidewall 18 of the foam casing and bladder 24. The controller 30 is thus oriented with its side faces extending in a vertical direction. The power lead 32 for the controller extends outwardly over the foam casing sidewall 18 along the parting line therebetween as the sidewall and casing upper portions 14 as illustrated in FIG. 2.

Figure 3:
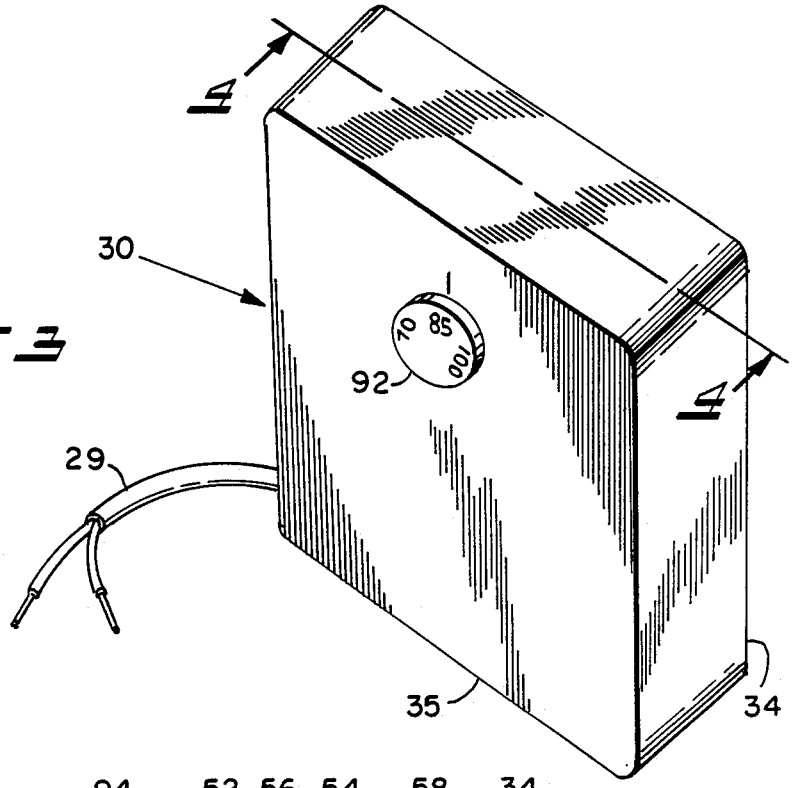
FIG. 3 is a somewhat perspective view of the thermostatic controller of the present invention in the preferred practice.

Referring to FIG. 3 the controller 30 is shown as having a case or housing formed in two half-shells 35,34 which are joined along a parting line 36 by any suitable expedient as, for example, non-metallic weldment. In the presently preferred practice, the half-shells 35,34 are preferably formed of suitable temperature resistant plastic material.

Figure 4:
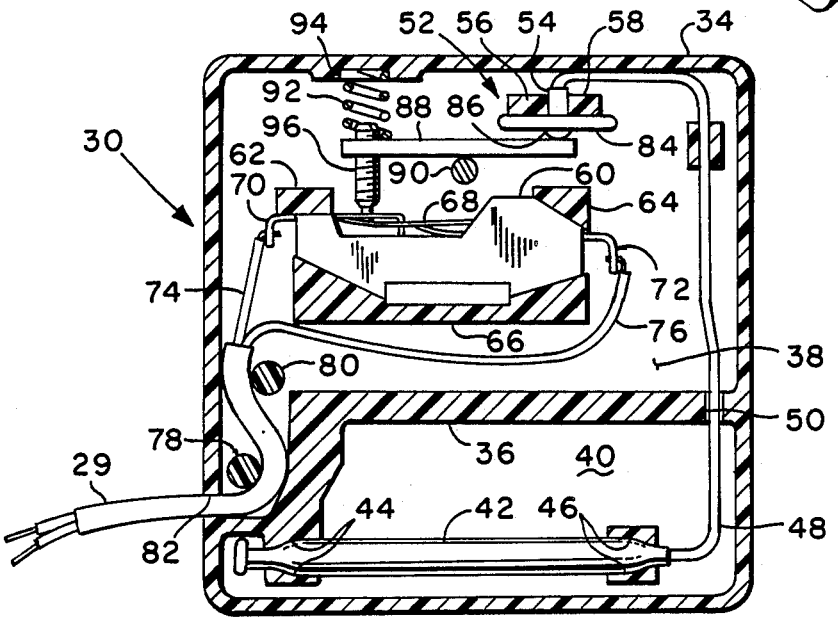
FIG. 4 is a section view taken along section-indicating lines 4—4 of FIG. 3.

Referring to FIG. 4, the controller 30 is shown in cross section wherein the half-shell 34 has partitions or walls 36 formed interiorly thereacross to divide the interior of the controller into an upper switching chamber 38 and a lower sensing chamber 40. It will be understood that the half-shell 35 has a corresponding symmetric wall portion 36 to match with the features of the half-shell 34.

A liquid filled bulb 42 is received in the sensing chamber 40 and is secured at opposite ends thereof by wedging between pairs of spaced lugs denoted 44,46 with the bulb 42 disposed adjacent the lower rim or wall of the half-shell 34.

One end of a capilary tube 48 is attached to the bulb 42 and the capillary tube passes through an aperture 50 provided in wall 36 and into chamber 38. The opposite end of the capillary tube is connected to a fluid pressure actuator indicated generally at 52. Actuator 52 has a base 54 extending from the back wall thereof received between two lugs 56,58 for retention onto half-shell 34.

A suitable switch such as snap acting micro switch 60 is disposed in the switching chamber 38 and is retained therein between lugs 62,64 and 66 which extend outwardly from the backwall of the half-shell 34. Switch 60 has an actuator spring member 68 operative to effect snap acting contact transfer upon movement thereof and also a pair of electrical connector terminals 70,72 extending from opposite ends of the switch. An insulated wire conductor 74 is connected to terminal 70 and an insulated wire conductor 76 is connected to terminal 72. The conductors 74,76 emanate from being and are encased in the lead 29 which is threaded about strain relief posts 78,80 provided on the half-shell 34. The lead 29 extends exteriorly of the controller 30 through an aperture 82 formed in the wall of half-shell 34.

Actuator 52 has a diaphragm 84 which expands under increasing fluid pressure, the diaphragm having a dimpled or raised portion 86 thereon which contacts one end of a lever 88 which is pivoted about a shaft having an eccentric 90. Eccentric 90 has its shaft rotatably received in the walls of the half-shells 34,35 and extending through the half-shell 35 which a temperature setting knob 92 mounted on the end thereof as shown in FIG. 3. The end of lever 88 opposite the dimple 86 is biased in a counterclockwise direction about eccentric 90 by one end of a compression spring 93 which has the opposite end thereof registering against the upper wall of the half-shell 34 in a recessed portion indicated by reference numeral 94.

An adjustment screw 96 is threadedly received through the end of the lever 88 extending interiorly of spring 92. The lower end of screw 96 extends through an aperture (not shown) in the terminal 70 for actuating the switch 60 to complete a circuit through the leads 74,76.

Contraction of diaphragm portion 86 permits spring 92 to bias lever 88 counterclockwise about eccentric 90 for actuation of switch 60. Conversely, expansion of the diaphragm 84 moves dimple 86 downwardly thereby causing lever 88 to rotate in a clockwise manner about eccentric 90 and raise the screw 96 to deactuate switch 60 thereby breaking the circuit through leads 74,76.

In the presently preferred practice, an access hole (not shown) is provided directly above the screw 96 for access thereto from the exterior of the shells 34,35, the access hole being filled after calibration of the switch lever mechanism at assembly. Selection of the desired switch actuating temperature is achieved by user rotation of knob 92 until the desired temperature indicated thereon aligns with a mark provided on the half-shell 35. Rotation of knob 92 in turn causes rotation of the eccentric 90 for changing the bias of spring 92 and thus the actuation point of the switch 60 with respect to a given temperature induced pressure level in the actuator 52.

Figure 7:
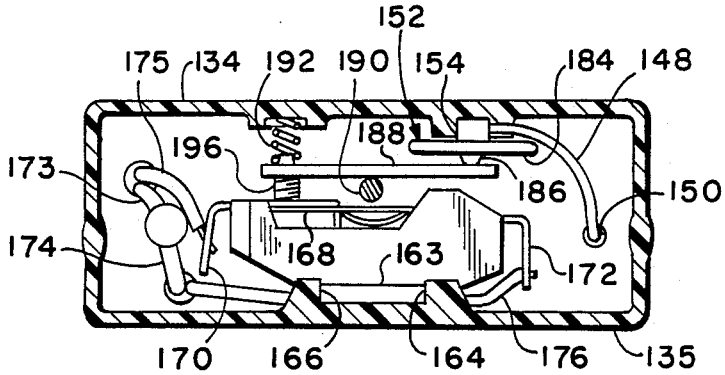
FIG. 7 is a section view taken along section-indicating lines 7—7 of FIG. 6.
Figure 5:
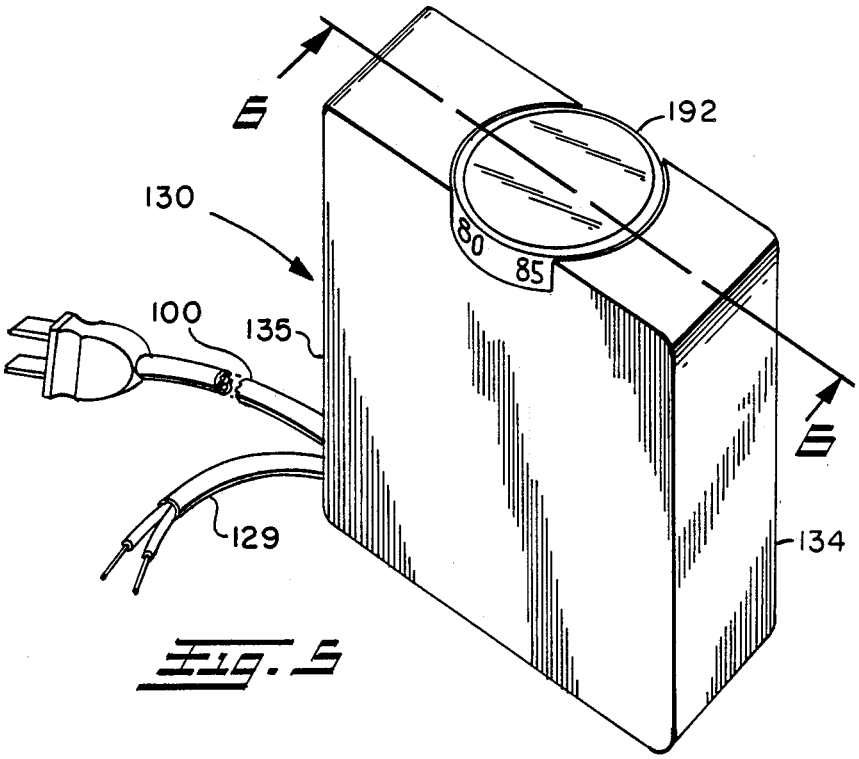
FIG. 5 is a view similar to FIG. 3 of an alternate embodiment of the invention.
Figure 6:
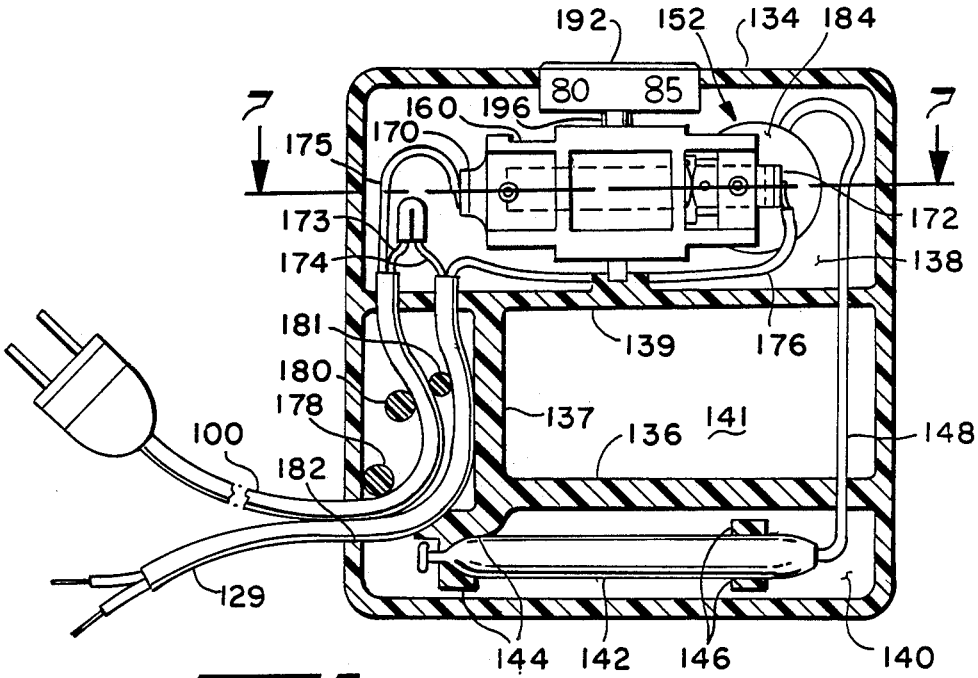
FIG. 6 is a section view taken along section-indicating lines 6—6 of FIG. 5.

Referring to FIGS. 5 and 6, an alternative embodiment indicated generally at 130 of the controller is illustrated wherein the temperature selection knob 192 is provided on shaft 196 which extends vertically such that the knob is accessable from the top of the controller when same is mounted with the sides of the half-shells disposed vertically. The controller 130 has a line power lead 100 extending through the aperture 182 provided in the wall of half-shell 134 in addition to a heater lead 129. The leads 129,130 are placed between strain relief posts 178,180,181 and are passed through suitable apertures provided in the partition 139 and extend into the switching chamber 138 formed by partition 139 and the upper portion of the wall of half-shell 134. A snap switch 160 is mounted in the chamber 138 by means of a pair of lugs 156,164 provided on the sidewall of the half-shell 135 as shown in Figure 7. The switch 160 has a snap acting blade 168 and a pair of electrical terminal connectors 170,172 provided on opposite ends of the switch. Insulated conductors 173,174 extend from the power line lead 100. Conductor 175 is connected to switch terminal 170 and the other conductor 173 is connected to conductor 174 from lead 129. Conductor 176 from lead 129 is connected to switch terminal 172.

Referring to FIGS. 6 and 7, a dead air chamber 141 is formed by partition 136 in half-shell 134 and is disposed between the upper switching chamber and the lower sensing chamber 140. Capillary 148 from the sensing bulb 142 extends through the dead air chamber 141 and through an aperture into switching chamber 138 for connection to the diaphragm actuator indicated generally at 152 which has an expandable diaphragm 184 thereon. Diaphragm 184 has a raised portion 186 thereon which contacts lever 188 pivotally mounted about eccentric 190. Lever 188 has an adjustment screw 196 provided on the opposite end thereof which contacts the blade spring 168 for effecting actuation of switch 160. A suitable bias spring 192 registers against the inside surface of the half-shell 134 and biases lever 188 in a counterclockwise direction about eccentric 190 to maintain the end of the lever in contact with the raised portion 186 of the actuator 152. It will be understood that functionally the operation of the controller 130 is similar to that of the controller 30 of FIG. 3; however, the adjustment knob which is connected to shaft 190 in the embodiment of FIGS. 6 and 7 extends upwardly through the wall of both half-shells as shown in detail in FIGS. 5 and 6. The controller 130 thus has a separate dead air chamber 141 disposed between the switching chamber 138 and the sensing chamber 140 for providing thermal isolation of the sensing bulb 142 from the snap acting switch 160 to prevent heat from the switch contacts from influencing the sensing bulb 142. The arrangement of the controller 130 particularly facilitates user rotation of the knob 192 for selection of the desired set temperature for the sensing bulb when the controller is disposed vertically between the side wall of the water bladder 24 and the side wall 18 of the foam casing.

The present invention thus provides a unique and novel thermostatic controller for a waterbed heater which enables the controller to be mounted between the side of the water bladder and the surrounding foam casing in an upright position. The present controller provides thermal isolation of the thermostatic sensing bulb employed in the controller from the heat of the switch mechanism to prevent switch induced offset of the selected temperature setting for water heating element.

I claim:

1. A temperature controller for a waterbed heater comprising:

(a) housing means formed of electrically insulative material, said housing means having oppositely disposed spaced generally parallel sides and adapted for mounting on the waterbed with said sides disposed generally vertically, said housing means including wall means defining:

(i) a switching chamber;

(ii) a sensing chamber;

(b) temperature sensing means comprising a liquid filled bulb disposed in said sensing chamber, with dead air space intermediate said sensing means and said switching chamber;

(c) switch means disposed in said switching chamber adapted for connection to a heater, and operable upon actuation and deactuation to make and break an electrical circuit connection;

(d) fluid pressure actuator means disposed in said switching chamber and including capillary means, connected to said temperature sensing means, said actuator means operable in response to a preselected sensed temperature to effect actuation of said switching means.

2. The controller defined in claim 1, wherein said housing means comprises a pair of half-shells each defining one of said sides, said shells joined about a parting line generally parallel to said sides.

3. The controller defined in claim 1, wherein said housing means comprises a pair of half-shells formed of non-metallic material and joined by non-metallic weldment.

4. The controller defined in claim 1, wherein said housing means comprises a pair of symmetric half-shells each defining portions of said chambers.

5. The controller defined in claim 1, wherein said switch means includes a subassembly comprising a switch mounting plate having a pair of contact means mounted thereon, said mounting plate being secured to said housing means in said switching chamber.

6. The controller defined in claim 1, wherein said housing means comprises a pair of half-shells joined along a parting line generally parallel to said sides; and, said switch means includes a pair of blade members mounted on one of said half-shells.

7. The controller defined in claim 1, wherein said switch means includes a snap-acting mechanism for opening and closing a pair of contacts.

8. The controller defined in claim 1, further comprising adjustment means, including a movable member accessible exteriorly of said housing movable for adjusting the actuation temperature of said controller.

9. The controller defined in claim 1, wherein said switch means includes (a) a lever mounted for pivotal movement in said switching chamber and operatively connected to said fluid pressure actuator; (b) adjustment means, user accessible, exteriorly of said housing means, for varying the bias of said lever means with respect to said actuator means for calibration of said controller.

10. The controller defined in claim 1, wherein said switch means is adjustable and includes a rotatable member extending exteriorly of said housing means, said member disposed on the top of said controller when same is mounted with said switching chamber vertically above said sensing chamber.

* * * * *